United States Patent [19]

Noffsinger

[11] Patent Number: 4,647,038

[45] Date of Patent: Mar. 3, 1987

[54] EXERCISER WITH STRAIN GAUGES

[75] Inventor: Kent E. Noffsinger, Butte, Mont.

[73] Assignees: Lee E. Keith; Stephen D. Morris, both of Buffalo, Wyo. ; part interest to each

[21] Appl. No.: 717,998

[22] Filed: Mar. 29, 1985

[51] Int. Cl.[4] ..... A63B 11/06

[52] U.S. Cl. ..... 272/123; 272/116; 272/143; 272/DIG. 5

[58] Field of Search ..... 272/93, 116, 125, 129, 272/130, 143, DIG. 5, DIG. 6, 122, 123; 73/379

[56] References Cited

U.S. PATENT DOCUMENTS

| | | | |
|---|---|---|---|
| 4,475,408 | 10/1984 | Browning | 73/379 |
| 4,501,148 | 2/1985 | Nicholas et al. | 73/379 |
| 4,531,728 | 7/1985 | Wright | 272/143 |

*Primary Examiner*—Leo P. Picard

*Attorney, Agent, or Firm*—Harvey B. Jacobson

[57] ABSTRACT

An exerciser with force measuring devices in the form of strain gauges interposed between an impingement member on the exerciser and a strain gauge on the impingement member engaged by the user of the exerciser. The exerciser impingement member includes a handgrip for engagement by the user with strain gauges being interposed between the handgrip and impingement member for measuring forces transmitted therebetween. The impingement member is disclosed as the exercise bar in barbells and the handgrip includes a pair of handgrips spaced from each other on the bar with each handgrip including isolated sets of strain gauges for measuring radial, axial and torque forces exerted by each hand of the user.

4 Claims, 5 Drawing Figures

EXERCISER WITH STRAIN GAUGES

BACKGROUND OF THE INVENTION

Field of the Invention

The present invention generally relates to a concept of and mechanism for measurement of forces during physical exertion and can be applied to various existing equipment. More specifically, this invention relates to the use of strain gauges to a monitor and measure forces and to generate output data indicative of the forces generated. The strain gauge force monitoring devices may be isolated as separate entities and applied to various training, exercising and rehabilitation devices. In one practical embodiment of the invention, the strain gauges are incorporated into handgrips so that the concept can be incorporated into virtually all present exercise devices and other devices that have handgrips. In addition, the strain gauges may be incorporated into foot pedals or other components at which forces are transferred or generated with respect to various equipment.

INFORMATION DISCLOSURE STATEMENT

Various types of exercise and rehabilitation equipment have been devised with the structure disclosed in my co-pending application, Ser. No. 670,344, filed Nov. 8, 1984, for Impingement Exerciser with Force Monitoring and Feedback System, the disclosure of which is incorporated herein by reference thereto, including an exerciser with an impingement member moved in a predetermined path and direction at a velocity and a force independent of each other with the user applying a resistance force to the impingement member at any point along or throughout its range of movement. The prior U.S. patents made of record in that application are also made of record in this application and in addition, the following U.S. patents relating to this field of endeavor are also made of record: U.S. Pat. Nos.

3,374,762, Mar. 26, 1968;
3,398,581, Aug. 27, 1968;
3,424,005, Jan. 28, 1969;
3,611,807, Oct. 12, 1971;
3,672,219, June 27, 1972;
4,103,896, Aug. 1, 1978.

As indicated in the prior art, strain gauges to measure forces have been utilized in combination with various equipment including exercise devices of various types but their functional potential and specific combination and relationship to exercise devices has not been fully recognized or developed.

SUMMARY OF THE INVENTION

An object of the present invention is to provide a mechanism utilized for force measurement during physical exertion by a human being or other entity capable of exerting forces in which force monitoring devices such as strain gauges are used to measure the forces and generate force readings with the force monitoring devices being capable of association with many different types of equipment used in physical training, exercise devices, rehabilitation devices and the like.

In the embodiment of the invention disclosed, strain gauges are incorporated into the handgrips mounted on an exercising bar having weights mounted thereon for weight training. The strain gauges are mounted internal to the handgrips and may be omni-directional in their measurement capabilities. While handgrips have been illustrated, it is also within the purview of the present invention to incorporate strain gauges or other force monitoring devices such as pressure sensitive film in associated with foot pedals or other entities which apply forces or receive forces with such devices being omni-directional, unidirectional, bi-directional or the like, so that output data is provided indicating the forces exerted.

Another object of the invention is to provide force monitoring devices associated with exercisers and the like incorporated into handgrips or similar devices in which isolated sets of strain gauges are employed so that gauge contact points engage the exercise bar only at opposite ends of the handgrip with the total force on the exercise bar being the vectoral sum of the forces produced by all contact points thereby permitting simple calculation of various forces produced between the handgrip assembly and the exercise bar.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
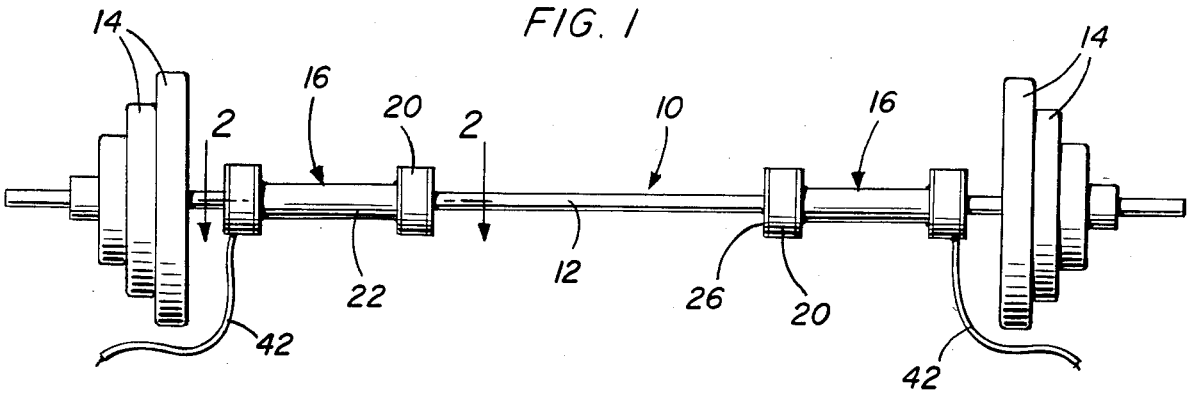
FIG. 1 is a side elevational view of a weight training exercise bar with weight plates thereon and handgrips on the bar constructed in accordance with the present invention.

Referring now specifically to the drawings, the embodiment of the invention as disclosed is associated with a weight training apparatus generally designated by reference numeral 10 in the form of a barbell which includes an exercise bar or weight bar 12 of conventional construction which has a plurality of weight plates 14 mounted thereon in a conventional manner with the weight plates being secured in place and removable and replaceable by the use of conventional removable collars and the like. The structure of the bar 12 and weight plates 14 is conventional and forms no particular part of the present invention except for the association of the present invention therewith to provide output data indicative of the forces generated between the bar 12 and a pair of handgrips 16 which are supported on the bar 12 in longitudinally spaced relation inwardly of the weight plates 14 with the spatial relationship between the handgrips 16 being such that a person using the barbell 10 will be able to comfortably grip the handgrips 16.

Each of the handgrips 16 includes a tubular sleeve 18 having an enlarged cylindrical housing 20 at each end thereof with a brass sleeve 22 disposed exteriorly of the sleeve 18 and enclosing the sleeve 18 and abutting and covering the inner surface of the inner end wall 24 of the housing 20. Also, a brass plate 26 forms a closure for the outer end of the housing 20 with the plate 26 being spaced from the periphery of the bar 12 which is provided with an internal bore 28.

Figure 2:
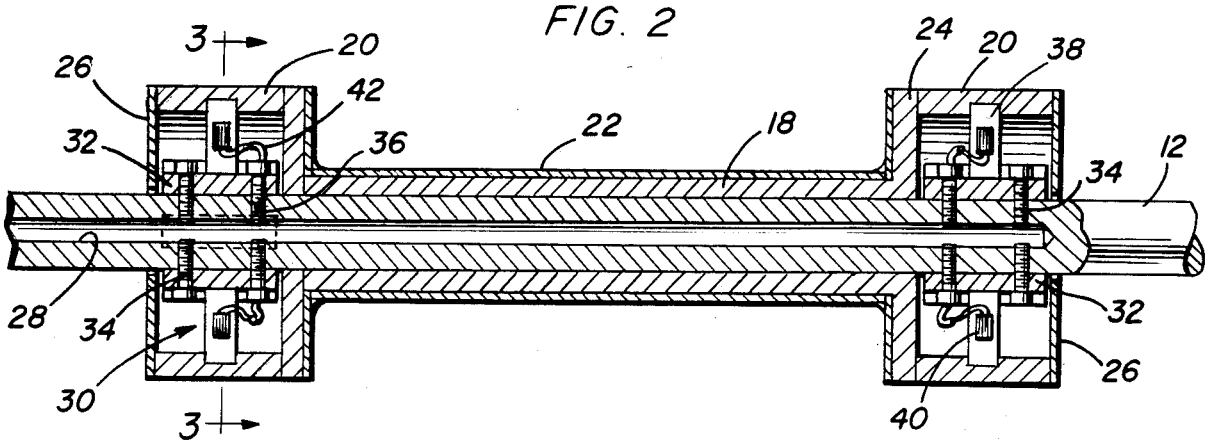
FIG. 2 is a longitudinal sectional view on an enlarged scale, taken substantially on a plane passing along section line 2—2 on FIG. 1 illustrating the specific structural details of the handgrip and the association of the strain gauges with the handgrip and weight bar.

Positioned in each of the housings 20 is a plurality of strain gauges 30 with each strain gauge 30 including a block 32 mounted longitudinally on the exterior of the bar 12 and secured thereto by a pair of set screws or cap screws 34 which are screw threaded into tapped holes 36 extending from the periphery of the bar 12 into the center bore 28 as illustrated in FIG. 2. The cap screws 34 have their heads recessed in counterbores in the exterior of the blocks 32. Each of the blocks 32 is thus rigidly affixed to the bar 12 and the blocks 32 are equally spaced about the periphery of the bar 12 with four blocks being illustrated in this embodiment of the invention.

Figure 3:
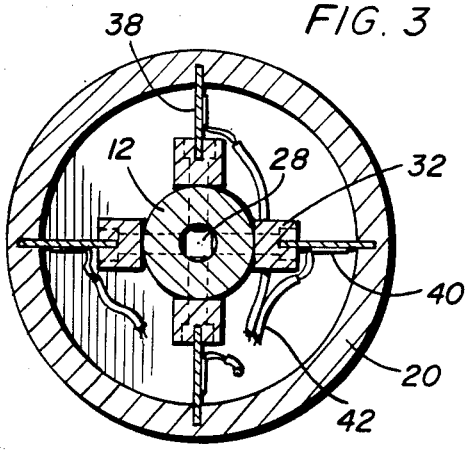
FIG. 3 is a transverse, sectional view taken substantially upon a plane passing along section line 3—3 on FIG. 2 illustrating further structural details of the association of the handgrip, strain gauges and weight bar.
Figure 4:
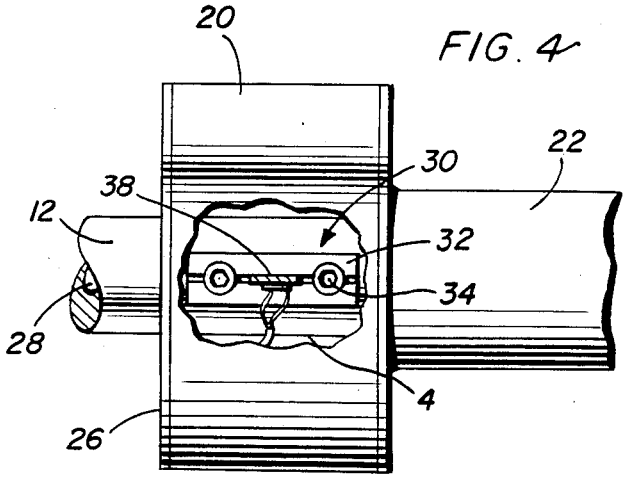
FIG. 4 is an elevational view of one end of the handgrip with portions broken away illustrating further structural arrangement.
Figure 5:
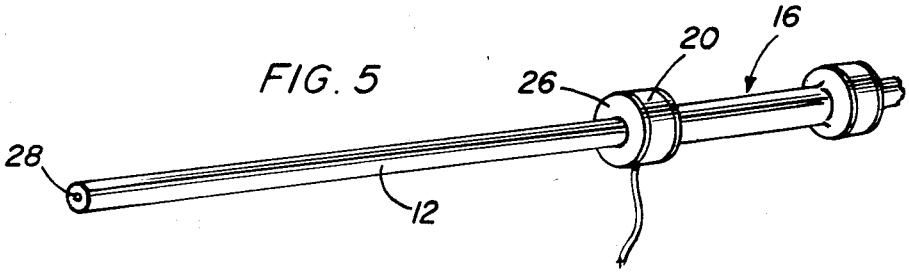
FIG. 5 is a fragmental perspective view of the handgrip and weight bar.

Interposed between each block 32 and the interior of the housing 20 which is rigid with the sleeves 18 and 22 is a flexible plate member 38 having a strain sensing elements 40 thereon having an electrical conductor 42 connected thereto. The plate members 38 have their end edges received in slots in the blocks 32 and the interior surface of the housing 20, respectively, as illustrated in FIG. 3 so that deflection of the plates 38 due to forces being transmitted between the handgrip sleeves 18 and 22 and the bar 12 will be measured by the strain gauge element 40 and a signal transmitted through conductor 42 to a device which will provide output data indicative of the forces transmitted between the bar 12 and the handgrip 16.

In the embodiment disclosed, if a "lifter" grasps the handgrips 16 and "snatches" the barbell, various forces would be generated at the various times for the corresponding positions throughout the lift. The strain gauges provide instantaneous force data which can be correlated to positional data in order to obtain a complete analysis of the lifter's performance. Burst or "firing" forces could be gauged at every position and an asymmetry could be quantified to determine if the right side is stronger or weaker than the left. In addition, instantaneous power output could be calculated as well as the total amount of energy generated for the total effort. Thus, substantially all questions meaningful to weight training could be satisfactorily answered.

While the handgrips are disclosed as being attached to the weight bar or exercise bar of barbells, they could be assembled with respect to substantially all current exercise devices that have handgrips and the readings obtained could greatly enhance the understanding of a user's performance throughout the performance range of movement and force. With the use of the strain gauges, rehabilitation analysis would be enhanced along with various athletic performance evaluations. Anyone engaged in a workout could monitor real time and the forces exerted on an exercising device such as a rowing machine for a later analysis so that home exercise devices could be greatly enhanced as measurement devices with feedback. This concept, of course, is not limited to handgrips, but could be incorporated into foot pedals of the type used on exercise cycles, rowing machines and the like with the strain gauges being constructed with various directional capabilities. By providing isolated strain gauges which engage the bar only in opposite ends of the handgrip, various characteristics of the forces exerted can be measured including raidal forces, axial forces and torque forces as well as the differences in such forces at opposite ends of the handgrips and at both handgrips.

The strain gauges or pressure sensitive film generates force data for real time display, recording and feedback control at the point of impingement for each handgrip independently, thereby providing the ability to quantify asymmetrical performance. Other quantities such as instantaneous power output and total energy expended can be derived by computer calculation or the like thereby providing a single system for developing total fitness.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A force monitoring device comprising an impingement member, user engaging means associated with said impingement member and multidimensional force measuring means interconnected with said impingement member and said user engaging means and measuring multidimensional forces passing therebetween, said impingement member is an elongated exercise bar with weight members mounted thereon, said user engaging means including a handgrip mounted on said bar for movement thereon and said force measuring means including strain gauge means interconnected with the bar and handgrip to independently measure radial, axial and torque forces exerted between the bar and handgrip, independent of the weight members on the bar.

2. The force monitoring device of claim 1 wherein said handgrip is elongated with strain gauges at each end thereof for independently measuring radial, axial and torque forces exerted between the bar and each end of the handgrip.

3. A force monitoring device comprising an impingement member, user engaging means associated with said impingement member and multidimensional force measuring means interconnected with said impingement member and said user engaging means and measuring multidimensional forces passing therebetween, said impingement member is an elongated exercise bar with weight members mounted thereon, said user engaging means including a pair of handgrips mounted in longitudinally spaced relation on said bar for movement relative thereto, said force measuring means including strain gauges interconnected with said bar and each of said handgrips to independently measure radial, axial and torque forces exerted between the bar and each of the handgrips to enable quantified measurement of forces associated with the left- and right-hand of the user independent of the weight members mounted on the bar.

4. The force monitoring device of claim 3 wherein each of said handgrips is elongated with strain gauges at each end of each handgrip for independently measuring radial, axial and torque forces exerted between the bar and each end of each handgrip.

* * * * *